US005470269A

United States Patent [19]

Ambroz

[11] Patent Number: 5,470,269

[45] Date of Patent: Nov. 28, 1995

[54] DUAL STRING YO-YO

[76] Inventor: Holly K. Ambroz, 2907 W. Cottage, Grand Island, Nebr. 68803

[21] Appl. No.: 293,892

[22] Filed: Aug. 22, 1994

[51] Int. Cl.[6] ..... A63H 1/30

[52] U.S. Cl. ..... 446/250; D21/99; 446/901

[58] Field of Search ..... 446/235, 236, 446/250, 251, 252, 247, 248, 901; D21/32, 98, 99

[56] References Cited

U.S. PATENT DOCUMENTS

| | | | |
|---|---|---|---|
| 207,527 | 8/1878 | Katz | 446/250 |
| 1,864,318 | 6/1932 | Powell | 446/250 |
| 3,207,508 | 9/1965 | Klemke | 446/248 |
| 3,228,140 | 1/1966 | White | 446/250 |
| 3,444,644 | 5/1969 | Sayegh | 446/250 |
| 4,273,275 | 6/1981 | Vadnais | 446/250 |
| 4,290,225 | 9/1981 | MacCarthy | 446/250 |
| 4,318,243 | 3/1982 | MacCarthy | 446/250 |
| 4,437,261 | 3/1984 | MacCarthy | 446/250 |

FOREIGN PATENT DOCUMENTS

| | | | |
|---|---|---|---|
| 137423 | 12/1902 | Germany | 446/236 |
| 1408251 | 10/1975 | United Kingdom | 446/250 |

OTHER PUBLICATIONS

"Experimental Fun with the yo–yo", by Al Renner, N.Y., 1979.

*Primary Examiner*—Robert A. Hafer
*Assistant Examiner*—Jeffrey D. Carlson

[57] ABSTRACT

A dual string yo-yo including a dual string interconnection of the yo-yo body to the fingers of an operator and a yo-yo body comprising enlarged end portion and an enlarged central portion separated by two necked portions whereupon the dual strings are separately wound. The yo-yo body may be of solid or structured composition and furthermore may include mass distributions devised to enhance the rotational inertial characteristics of the yo-yo. A pair of adjustable bandlike string attachment bands is provided to engage a pair of fingers of an operator. Irregular shapes and lighted versions are disclosed.

1 Claim, 4 Drawing Sheets

DUAL STRING YO-YO

BACKGROUND OF THE INVENTION

1. Field of the Invention

The present invention relates to yo-yo entertainment devices and more particularly pertains to a dual string yo-yo which may be employed to impart superior stability to yo-yo entertainment devices thereby permitting simplified operation thereof.

2. Description of the Prior Art

The use of yo-yo's is known in the prior art. More specifically, yo-yo's heretofore devised and utilized for self entertainment and for the entertainment of others are known to consist basically of familiar, expected and obvious structural configurations, notwithstanding the myriad of designs encompassed by the crowded prior art which have been developed for the fulfillment of countless objectives and requirements.

The present invention is directed to improving devices for a dual string yo-yo in a manner which is safe, secure, economical and aesthetically pleasing.

For example, U.S. Pat. No. 3,452,474 to Zopf discloses a yo-yo comprising a single string yo-yo including two transparent hemispherical globes having a string windedly disposed therebetween and having a battery and electric lamp pair disposed therein. There is no provision in the Zopf invention for a plurality of strings. The present invention comprises a yo-yo having two strings for active suspension of the yo-yo.

In U.S. Pat. No. 4,895,547 to Amaral a superior performance yo-yo is disclosed comprising a yo-yo having a low friction centrally disposed spool freely rotating with respect to an axle wherein the axle interconnects two yo-yo halves. There is no provision in the Amaral invention for a plurality of strings and string engaging slots. The present invention comprises a dual string dual slot configuration imparting enhanced stability to the yo-yo.

In U.S. Pat. No. 4,332,102 to Caffrey a superior performance yo-yo is described. The Caffrey invention comprises a yo-yo having a centrifugal clutch mechanism disposed therein which disengages the yo-yo body from an axle to which the string is attached when high rotational speeds are attained and engages the yo-yo body when rotation slows or upon command. There is no provision for a plurality of strings in the Caffrey invention. The present invention comprises a yo-yo having two strings attached thereto.

In U.S. Pat. No. 4,492,057 to MacCarthy a yo-yo with non-circular cross-sectional axle is disclosed for a yo-yo having a singular tape or string actuation means. A disadvantage in this prior art lies in a lack of a plurality of tape or string members employable for actuation thereof. The present invention employs two strings for actuation of the yo-yo.

U.S. Pat. No. 4,437,261 to MaCarthy discloses a yo-yo with twist-resistant string. The disclosure teaches a yo-yo having a string of non-twisting construction. The disclosure makes no provision for two or more strings. The present invention comprises a yo-yo having two strings wherein the strings are separated and are disposed in separated groove portions of the yo-yo body.

In this respect, the dual string yo-yo according to the present invention substantially departs from the conventional concepts and designs of the prior art, and in so doing provides an apparatus primarily developed for the purpose of providing a dual string yo-yo of enhanced stability.

Therefore, it can be appreciated that there exists a continuing need for new and improved dual string yo-yo which can be used for enhanced stability. In this regard, the present invention substantially fulfills this need.

As illustrated by the background art, efforts are continuously being made in an attempt to improve yo-yos. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of yo-yo now present in the prior art, the present invention provides an improved yo-yo construction wherein the same can be utilized for improved stability of a yo-yo toy. As such, the general purpose of the present invention, which will be described subsequently in greater detail, is to provide a new and improved dual string yo-yo apparatus and method which has all the advantages of the prior art yo-yos and none of the disadvantages.

The invention is defined by the appended claims with the specific embodiment shown in the attached drawings. For the purpose of summarizing the invention, the invention may be incorporated into a rotationally symmetric spoolike yo-yo body having two string engagement necks disposed therein and furthermore having two strings wherein each are affixed to an unoccupied minimal diameter portion of the string engagement necks. A free end of each string is affixed to a finger engagement band or loop which may be slidably introduced upon two fingers of one or more hands. The dual string yo-yo is susceptible to enhanced stability by employing two separated strings to maintain the rotational axis of the yo-yo body free of parasitic rotation about other axes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved dual string yo-yo having provision for use of two strings upon a singular yo-yo body for the purpose of enhancing stability thereof.

It is therefore an additional object of the present invention to provide a new and improved dual string yo-yo which has all the advantages of the prior art yo-yos and none of the disadvantages.

It is another object of the present invention to provide a new and improved dual string yo-yo which may be easily and efficiently manufactured and marketed.

It is a further object of the present invention to provide a new and improved dual string yo-yo which is of a durable and reliable construction.

An even further object of the present invention is to provide a new and improved dual string yo-yo which is susceptible of a low cost of manufacture with regard to both materials and labor, and which accordingly is then susceptible of low prices of sale to the consuming public, thereby making such dual string yo-yos economically available to the buying public.

Still yet another object of the present invention is to provide a new and improved dual string yo-yo which provides in the apparatuses and methods of the prior art some of the advantages thereof, while simultaneously overcoming some of the disadvantages normally associated therewith.

Still another object of the present invention is to provide a new and improved dual string yo-yo having a detachable band means for releasable attachment of strings thereof to the fingers of a user.

Yet another object of the present invention is to provide a new and improved dual string yo-yo having minimal susceptibility to string twisting by employing counterwound strings thereon.

Even still another object of the present invention is to provide a new and improved dual string yo-yo having an elongated yo-yo body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
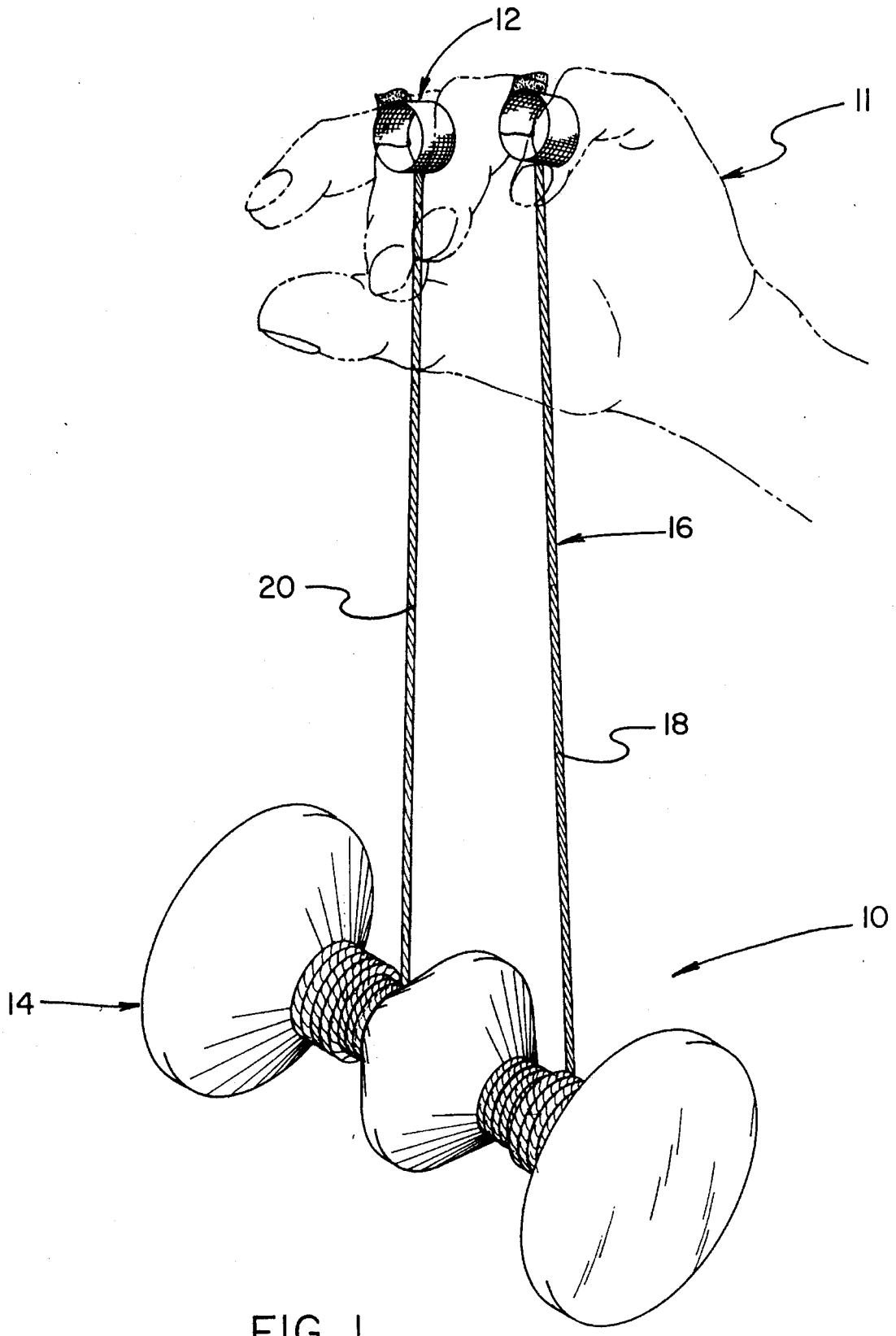
FIG. 1 is a perspective view of the dual string yo-yo showing an operational disposition.

With reference now to the drawings, and in particular to FIG. 1 thereof, a new and improved dual string yo-yo embodying the principles and concepts of the present invention and generally designated by the reference numeral 10 will be described. Throughout the reminder of this document the term yo-yo will be defined as—a thick grooved double disk with a string attached to its center which is made to fall and rise to the hand by unwinding and rewinding on the string, This definition is as it appears in *Webster's New Collegiate Dictionary.*

From an overview standpoint, the dual string yo-yo 10 is adapted for use by a human operator 11 applying finger engagement bands 12 and releasing yo-yo body 14 which is supported by inertial reactive forces transmitted through tension in unwinding strings 16. See FIG. 1.

More specifically, it will be noted that the dual string yo-yo 10 comprises a yo-yo body 14 having two strings 16 affixed thereon and furthermore strings 16 each have finger engagement bands 12 affixed to the free ends thereof. Strings 16 comprise flexible elongated yarnlike members constructed to minimize twisting under conditions of repeated winding and unwinding under tension upon body 14. Some advantage may be gained by having a first string member 18 having a conterlaid, or twisted construction in contrast to second string member 20 wherein the natural torque generating susceptibility of first string member 18 is nulled by the natural torque generating susceptibility of second string member 20 thereby eliminating any tendency of the yo-yo body 14 to undergo rotation in a plane orthogonally disposed to the axis of any enstraightened string segment.

Figure 2:
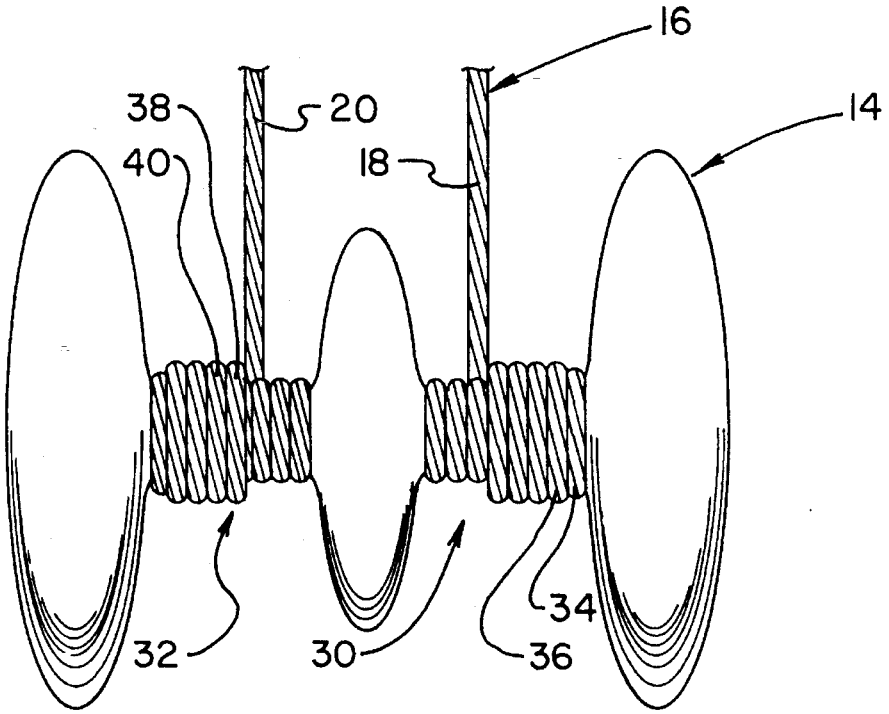
FIG. 2 is a fragmentary side elevational view of the dual string yo-yo in a partially extended position.
Figure 3:
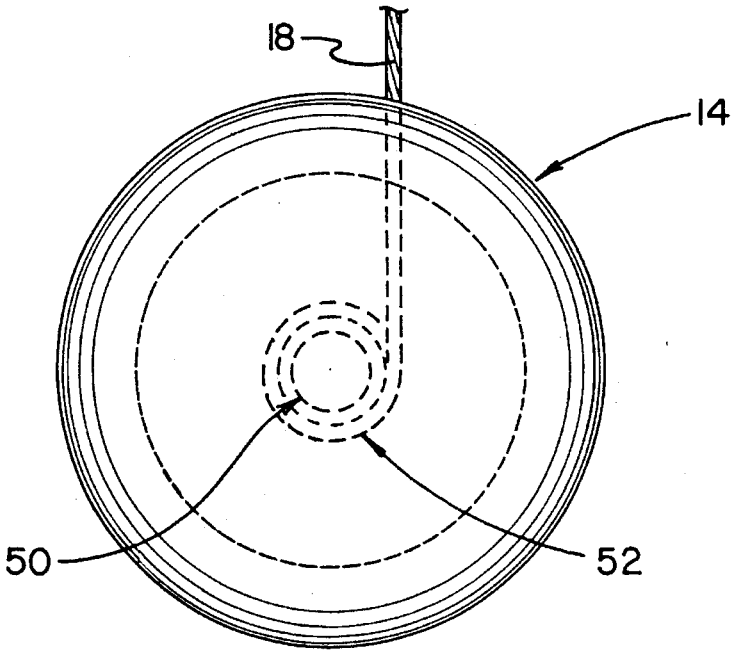
FIG. 3 is side elevational view of the dual string yo-yo showing the disposition of a string thereon.

First string member 18 is caused to build and deplete in first neck 30 and second string member 20 is likewise caused to build and deplete in neck 32 wherein both neck 30 and 32 are features disposed upon yo-yo body 14. See FIG. 2. Under ideal conditions first string member will build in neck 30 by forming a series of adjacently laid windings 34 and 36 in response to rotation of yo-yo body 14 and fastening or frictional engagement of first string member thereto. Likewise, second string member 20 builds in neck 32 by forming a series of adjacently laid windings 38 and 40. After first string member 18 windingly fills a layer extending from neck wall 42 to neck wall 44 forming a first layer 50 a second layer 52 begins forming. See FIG. 3. Likewise, second string member 20 builds in neck 32 in a similar manner.

Figure 4:
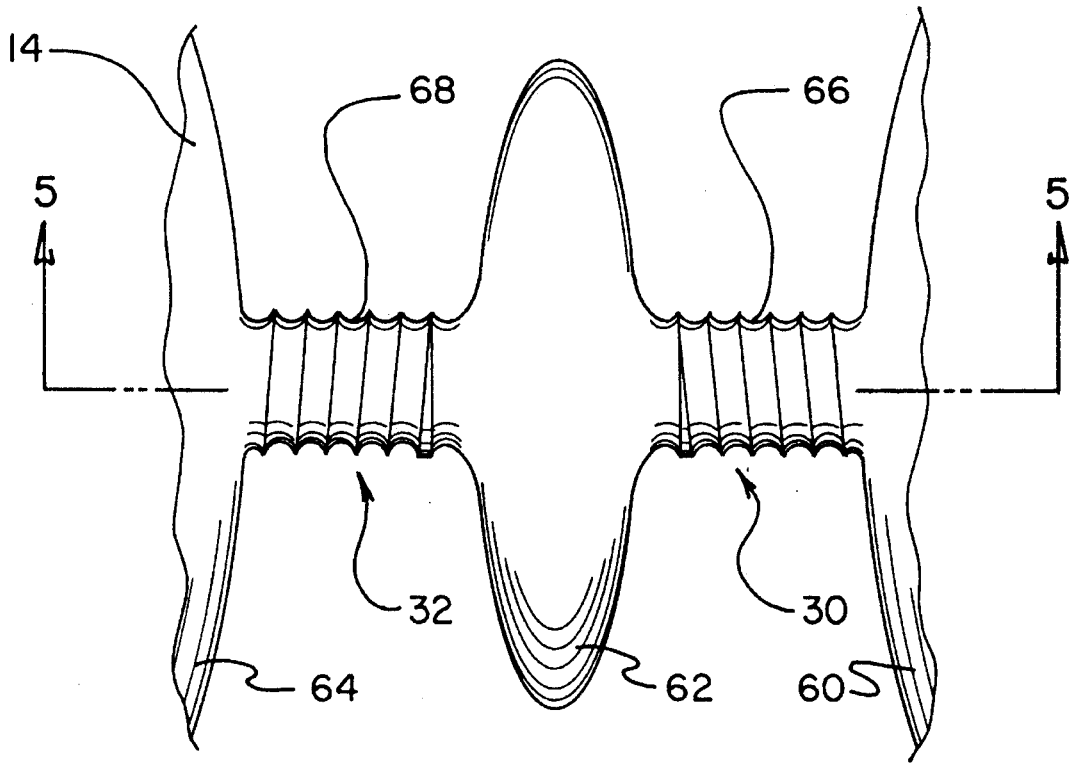
FIG. 4 is a fragmentary side elevational view of the dual string yo-yo showing a string organization feature.
Figure 5:
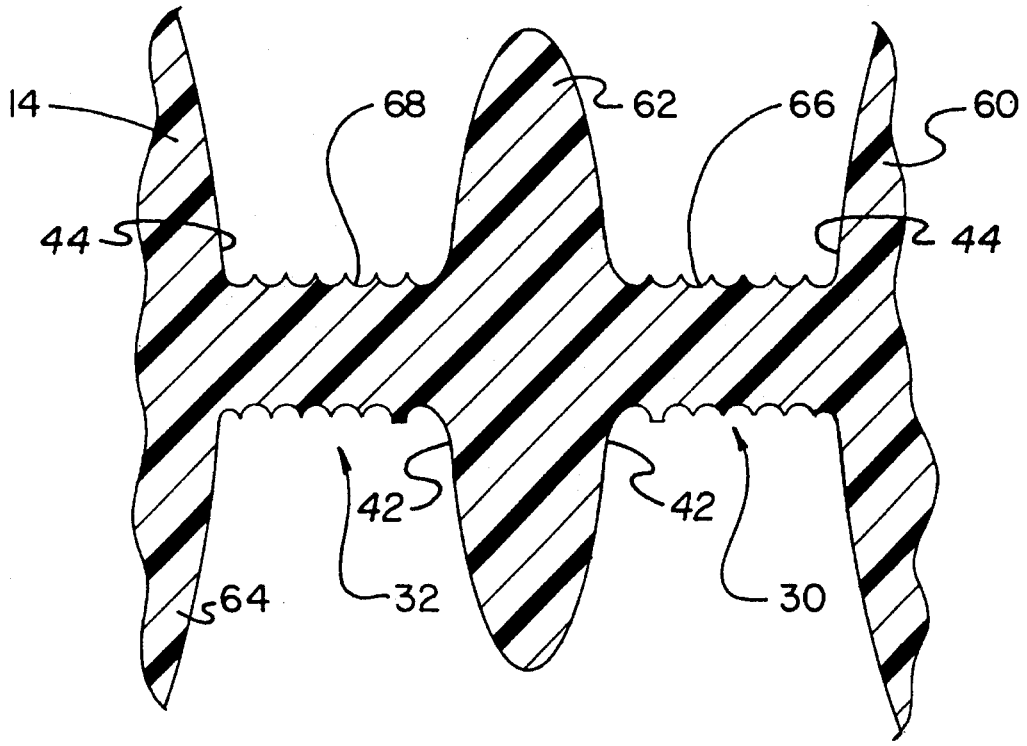
FIG. 5 is a fragmentary side sectional view of a dual string yo-yo taken substantially upon the plane indicated by the section line 5—5 of FIG. 4.

Yo-Yo body 14 comprises an elongated polymeric, wooden or metallic form having a rotational axis longitudinally disposed therein and furthermore having a center of mass lying substantially upon the rotational axis and the center of mass is additionally substantially disposed in equidistance from the remotest extent of yo-yo body 14 along the axis of rotation. See FIGS. 4 and 5. In general, the yo-yo body 14 is rotationally symmetric in shape about the rotational axis and is mirror symmetric in shape about a plane orthogonally disposed to the axis of rotation and located equidistant to the furthest free ends of the yo-yo body 14 falling substantially upon the rotational axis.

Yo-Yo body 14 may be hollow, solid, or may have a structure therewithin. Yo-yo body 14 comprises a first end portion 60, neck 32, central portion 62, neck 30, and second end portion 64. First end portion 60 comprises a smoothly enlarged knob having a diameter capable of trapping all string wound at neck 30 and furthermore the diameter of first end portion 60 is selected to provide a desirable rotational inertia which controls the angular acceleration of the yo-yo body during use. Mass distribution within first end portion 60 may also be developed to create a particular inertia value which can provide a low overall mass dual string yo-yo 10 having a slow rotational response and long duration of free rotation in a sleeper mode indicated by having the strings 16 fully extended and loopedly affixed to the necked portions of the yo-yo body 14.

Central portion 62 comprises a flattened bulbous enlargement separating first and second string members 18 and 20 permitting building of wound string 16 in first and second neck 30 and 32 without cross engaging first string member 18 and second string member 20. Central portion 62 is of similar composition to first end portion 60 and may have similar or differing mass concentrations therein to provide desirable inertial character. Generally, central portion 60 is of low net mass and mass concentration is in the first and second end portions 60 and 64. Second end portion 64 is substantially a mirror image of first end portion 60 taken upon a plane orthogonal to the yo-yo body 14 rotational axis and passing through center of central portion 62.

First neck 30 may comprise a smooth cylindrical interconnection of first end portion 60 and central portion 62 or first neck 30 may comprise a cylinder having a spiralling threadlike groove 66 disposed therein. Groove 66 enables first string member 18 to begin winding buildup in a particular direction producing a well defined layer thereby enabling other well defined layers to build thereon. Second neck 32 comprises a mirror image of first neck 30 and may have a smooth or grooved cylindrical shape. If second neck 32 is grooved the grooves 68 comprise a spiral mirror of grooves 66 and thereby permit string build upon neck 32 to wind in lateral opposition to string build disposed upon neck 30 thereby eliminating a propensity for translation of yo-yo body 14 along the axis of rotation thereof.

Figure 6:
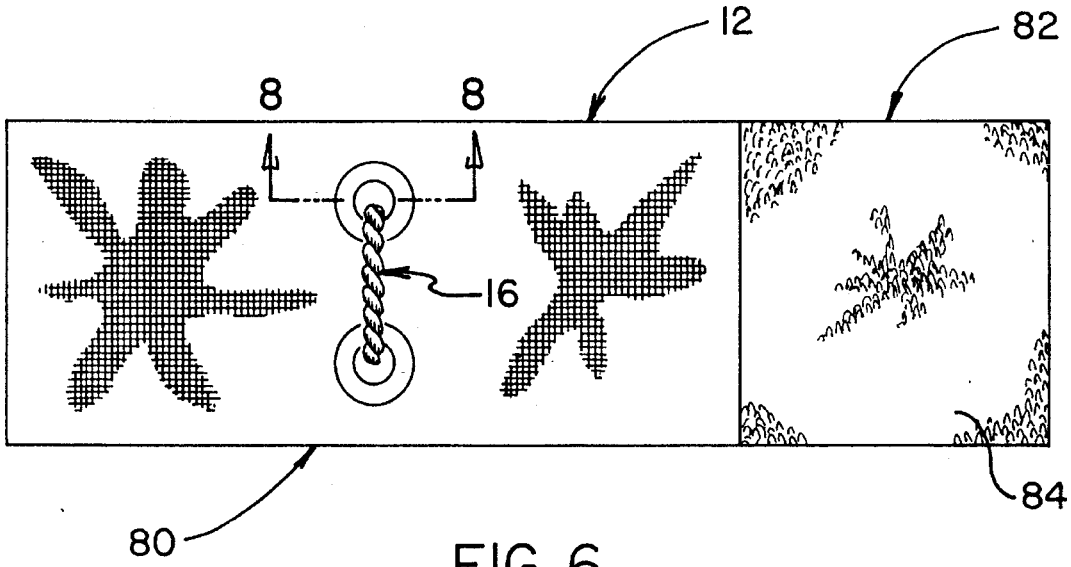
FIG. 6 is a side elevational view of the dual string yo-yo showing a detachable finger engagement band.
Figure 7:
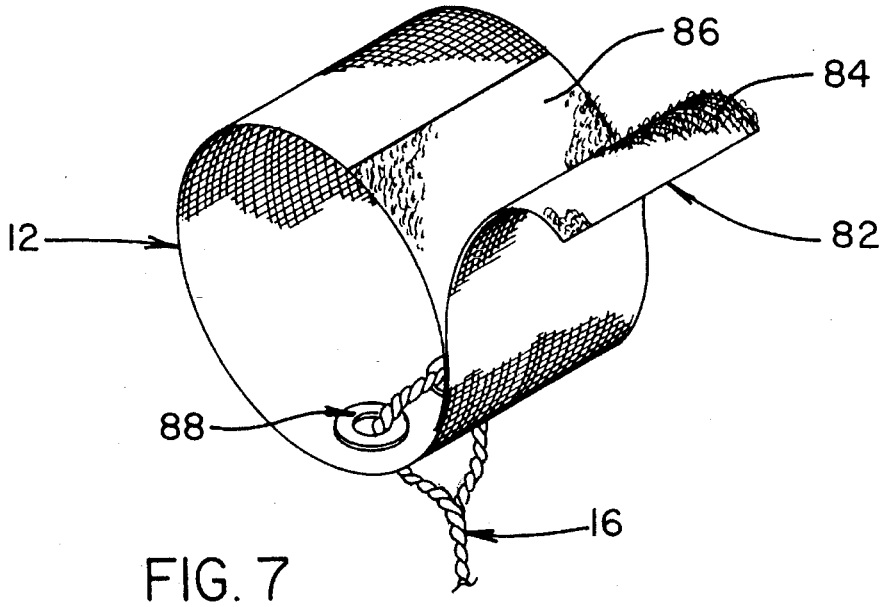
FIG. 7 is a perspective view of the dual string yo-yo showing a detachable finger engagement band.
Figure 8:
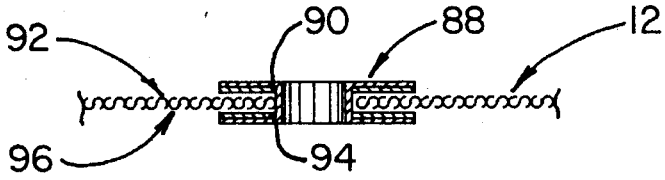
FIG. 8 is a fragmentary side sectional view of a dual string yo-yo taken substantially upon the plane indicated by the section line 8—8 of FIG. 6 and furthermore showing a string engaging grommet member.

Finger engagement band 12 comprises an elongated flexible straplike member 80 having a coactive fastening means 82 disposed thereon for providing adjustable fastening to a variety of human finger sizes. See FIGS. 6 and 7. Elongated flexible straplike member 80 comprises a fabriclike construction having a first coactive fastener portion 84 disposed upon an end thereof and a second coactive fastener portion 86 disposed upon an opposing end and surface thereof, and furthermore having a grommet pair 88 through which string 16 is loopedly fastened thereby affixing dual string yo-yo 10 to a human operator. First coactive fastener portion 84 comprises a pile section and second coactive fastener portion 86 comprises a plurality of minute hooklike members which releasably engage the pile section upon contact. Grommet pair 88 comprises a rivetlike device having a first portion 90 disposed upon a first surface 92 of straplike member 80 and a second portion 94 disposed upon a second surface 96 of straplike member 80 and furthermore the first portion 90 and second portion 94 are bonded to form a rivetlike member having a centrally disposed through hole penetrably formed in straplike member 80. See FIG. 8.

In an alternate embodiment, the yo-yo body 14 may be irregularly shaped and may incorporate substantially sharpened edges, however the mass symmetry and string 16 disposition symmetry is preserved. Direct electrical, chemiluminescent, phosphorescent, and fluorescent self illumination of the dual string yo-yo 10 is feasible.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A new and improved dual string yo-yo toy for human entertainment comprising:

first and second string members attached to a body member, said body member having an axis of rotational symmetry wherein the body member comprises a cylinder having a first end portion of enlarged diameter, a first neck portion of smaller diameter, a central disposed portion of enlarged diameter, a second neck portion of smaller diameter, and a second end portion of enlarged diameter, said first neck portion and said second neck portion comprise substantially solid cylindrical shapes and are susceptible to windingly disposing and recovering portions of two string members thereon, furthermore said first neck portion has a spirally formed channel producing a first threadlike string engaging feature, and said second neck portion has a spirally formed channel producing a second threadlike string engaging feature wherein said first end second threadlike features exhibit mirror symmetry about a plane orthogonally disposed to the axis of rotational symmetry and passing through the center of the body member whereby said channels are capable of assisting the orderly winding and unwinding of the strings;

each of the string members having a free end, wherein said string members are affixed to said body member, and;

a first finger engagement means capable of attaching a human finger and said free end of the first string member;

a second finger engagement means capable of attaching a human finger and said free end of the first string member.

* * * * *